US007055475B2

(12) United States Patent
Denteler et al.

(10) Patent No.: US 7,055,475 B2
(45) Date of Patent: Jun. 6, 2006

(54) ROTARY ACTUATOR DEVICE TO CONTROL THE STROKE OF A CHARGE EXCHANGE POPPET VALVE IN THE CYLINDER HEAD OF AN INTERNAL COMBUSTION ENGINE

(75) Inventors: Johannes Denteler, Moosburg (DE); Johannes Meyer, Karlsfeld (DE)

(73) Assignee: Bayerische Motoren Werke AG, Munich (DE)

( * ) Notice: Subject to any disclaimer, the term of this patent is extended or adjusted under 35 U.S.C. 154(b) by 0 days.

(21) Appl. No.: 10/777,215

(22) Filed: Feb. 13, 2004

(65) Prior Publication Data

US 2004/0221824 A1 Nov. 11, 2004

Related U.S. Application Data

(63) Continuation of application No. PCT/EP02/07998, filed on Jul. 18, 2002.

(30) Foreign Application Priority Data

Aug. 17, 2001 (DE) ..... 101 40 461

(51) Int. Cl.
*F01L 1/34* (2006.01)

(52) U.S. Cl. ..... 123/90.16; 123/90.39; 123/90.44

(58) Field of Classification Search .. 123/90.15–90.18, 123/90.21, 90.24–90.27, 90.39–90.47, 90.2, 123/90.52, 90.6; 74/53–55, 567, 569, 595, 74/596

See application file for complete search history.

(56) References Cited

U.S. PATENT DOCUMENTS

| | | | | |
|---|---|---|---|---|
| 4,455,543 | A | 6/1984 | Pischinger et al. | |
| 5,494,007 | A | 2/1996 | Schroeder et al. | |
| 5,873,335 | A | 2/1999 | Wright et al. | |
| 5,905,917 | A * | 5/1999 | Imura | 396/55 |
| 6,314,926 | B1 * | 11/2001 | Meneely et al. | 123/90.16 |

FOREIGN PATENT DOCUMENTS

FR 2 608 675 A 6/1988

* cited by examiner

*Primary Examiner*—Thomas Denion
*Assistant Examiner*—Ching Chang
(74) *Attorney, Agent, or Firm*—Crowell & Moring LLP

(57) ABSTRACT

For a rotary actor device for stroke control of a charge changing valve in the cylinder head of an internal combustion engine with rocking stepper motor for driving a control disk with a cam profile controlling a charge changing valve, wherein the rocking motor is operated accordingly, an interplay of a closing spring of the poppet valve with a biased spring arm, provision is made for the achievement of stable end positions of the control disk, such that it is positioned by means of a separate first and second rotary abutment and is held securely against rotation in the particular starting position by the opening spring acting on a shaft bearing the control disk, while in each case by means of a relatively low powering of the stepper motor or of a ricochet movement brought about by means of corresponding abutments to overcome the starting position, the further supply of power remains substantially reduced by means of a rotor of the rocker motor chosen according to the energy exchange between closing spring and arm spring in a rotor of the rocker motor chosen to correspond to its flywheel moment.

28 Claims, 1 Drawing Sheet

ROTARY ACTUATOR DEVICE TO CONTROL THE STROKE OF A CHARGE EXCHANGE POPPET VALVE IN THE CYLINDER HEAD OF AN INTERNAL COMBUSTION ENGINE

CROSS REFERENCE TO RELATED APPLICATIONS

This application is a continuation of International Patent Application No. PCT/EP02/07998, filed Jul. 18, 2002, designating the United States of America, and published in German as WO 03/016683 A1, the entire disclosure of which is incorporated herein by reference. Priority is claimed based on German Patent Application No. 101 40 461.1, filed Aug. 17, 2001.

BACKGROUND AND SUMMARY OF THE INVENTION

The invention relates to a rotary actuator device for controlling the stroke of a charge exchange poppet valve in the cylinder head of an internal combustion engine.

To reduce the fuel consumption of internal combustion engines and to reduce pollutants in the exhaust gas, and furthermore to influence the torque performance of an internal combustion engine over the entire rotary speed range, valve operators have become known in which the open and close times of the intake and exhaust valves, as well as variable valve strokes in the intake valves are operated by means of electrical actuators controlled by electronic maps.

FR 2 608 675 A1 shows and describes a reciprocating internal combustion engine with a valve operator comprising several control cams for similar poppet valves of one cylinder. The cams are powered by an electronically mapped electric motor for the purpose of varying the open and close timing of the poppet valves relative to the crankshaft through a reference cylinder. Since in this known valve control with the various cams, the force of the closing spring has to be overcome when the poppet valve opens, a considerable amount of current is required for the electric motor and the rotary actuator. This places a considerable load on the on-board electrical system of a vehicle equipped with such an internal combustion engine.

It is known that this considerable current load on the electrical system or on-board network can be considerably reduced if an opening spring is associated with the closing spring of a poppet valve. Between the oppositely acting springs in the lifting of a gas exchange valve, the spring energies vary to reinforce the electromagnetic forces in the particular lift actuator, like the one disclosed for example by German Patent DE 30 24 109 C2. Such stroke actuators, which are configured as a mass-spring oscillating system for controlling the movement of a gas exchange valve, have especially the disadvantage of considerable structural height.

Lastly, U.S. Pat. No. 5,873,335 discloses a rotary actor device, in which a cam of common design driven by an electric motor cooperates with the poppet valve biased by a closing spring, and is in communication with a tappet, which is orthogonally disposed to the poppet valve and slides on the cam under the action of an opening spring. In this valve drive the oscillation of spring energies serves also to reduce the electrical energy drawn by the rotary actor. However, the disadvantage is especially in the unstable position of the control cam when the poppet valve is closed because the tappet is situated in the dome area under the biased opening spring. In the event of a slight deviation of the cam apex on the control cam, the spring produces a torque in the direction of rotation or contrary thereto and has to be compensated by a counter-torque of the actuated electrical rotary actor. This leads to a lengthy drain on the on-board electrical system, especially when the internal combustion engine is not running.

The invention addresses the problem of improving a rotary actor device for controlling the stroke of a poppet valve in the cylinder head of an internal combustion engine such that a control disk with a cam profile is perfectly secured in the end positions of the poppet valve when the internal combustion engine is not running, without powering the electric motor. Only relatively little to no electrical energy need be supplied to the electrical rotary actor to leave the secured positions.

One of the advantages of the invention is that, when the control disk is in its end position, overshooting is securely prevented. Further, due to the mechanical end stops, there is no need to supply current to the torsional pendulum motor to reach or retain an end position of the control disk. In the operation of the rotary actor device, the rotor in the rotary rocking motor is set in rotation up to a predetermined frequency of oscillation by a slight supply of energy to overcome the initial starting position. From then on the accumulated tension of the opening spring is converted to kinetic rotational energy of the rotor. The rotor is accelerated from the basic rotational phase until it reaches the cam ramp at the start of the cam flank. When the cam flank is reached the energy of the opening spring is substantially converted, while the control disk in co-rotation with the rotor has reached a maximum rotating speed. The charge change poppet valve is opened, the energy necessary for that purpose is taken from the kinetic rotational energy of the rotor, and the rotor speed begins to decrease. When the charge change poppet valve reaches its maximum opening stroke, the rotor's speed is virtually nil and the control disk affixed to the rotor reaches the second end abutment. The opening spring can in this case still exert a positive torque for securing the second rotary position or second starting position. This has the advantage that the valve-open position can be held according to the motor's requirements.

To close the charge change poppet valve, oppositely directed energy is fed to the rocker motor to leave the second starting position. Thereafter the rotor of the rocker motor is accelerated by the cam flank by the expanding closing spring of the poppet valve, and at the same time the tensing of the opening spring begins. During the closing action of the charge exchange valve, the rotor reaches a maximum velocity and kinetic energy, by which the opening spring is tensed through the lever attached to the shaft of the rotor, while the control disk already cooperates with the transfer element of the valve drive through the ground circuit. The rotation of the rotor is stopped against the first end rotation abutment up to a predetermined rocking frequency, and the starting position thus reached is secured according to the invention by the opening spring acting on the lever.

When the rotary actor device according to the invention is operated beyond the preset rocking frequency of the shaft, the starting position secured in each case is overcome by a ricochet movement produced by a resilient deformation of one of the colliding stops, which accelerates the shaft with the rotor in the direction of the ricochet movement such that the rocker motor does not have to be supplied with any substantial energy to make it leave the secured starting position.

An additional advantage of the invention is that during a prescribed cycle comprised of the opening and closing of a charge exchange valve, the necessary energy required by friction in the system and gas work at the charge exchange valve can be supplied at any time.

In a preferred embodiment of the invention, the control disk has a half cam profile which has a cam flank between a break-over point and a base circle for opening and closing. The cam flank has a ramp at which the control disk has in a diametric area a base circle section prolonged in the circumferential direction, which is adjoined by an abutment pointing substantially radially to the cam break-over area for the first end rotary abutment arranged on the motor or cylinder head side.

With the configuration described above, a control disk of reduced mass is advantageously achieved with an integrated abutment. Furthermore, with this control disk with a ramp provided between the base circle and the cam flank, the valve acceleration can be advantageously influenced to obtain good sound through additional control of the rocker motor.

In further development of the invention, the lever joined for rotation with the shaft adjacent the control disk bears in its free end area a ball-bearing mounted roller with a circumferential guiding groove, by which the free, biased spring arm wound in a screw thread manner and made of round wire is carried positioned in/on the cylinder head is borne as an opening spring over the turning range of the lever. The control disk in contact with the first end abutment when the poppet valve is closed is secured in this starting position by a bent end section of the spring arm which is urged against the roller.

With the use of a one-armed spring as the opening spring according to the invention, it is advantageously possible to achieve a compact spring of appropriate spring force requiring little space and ease of arrangement. Since it serves in an additionally advantageous manner also to secure abutment, the result according to a further proposal is that the end section is bent with respect to the spring arm such that a small component of force acting on the roller in the opening direction of the poppet valve is involved. Thus the starting energy input for the rocker motor is advantageously reduced.

This applies to the second rotary abutment according to an additional proposal, according to which the end section is further bent away from the arm of the spring such that, in the case of the maximum opening stroke of the poppet valve achieved at the second end rotary abutment, a torque approaching zero is produced.

The measures described above apply to the rotary actor device until a predetermined rocking frequency is reached by the shaft attached to the rotor.

In an additional embodiment of the invention, the first end rotary abutment when the internal combustion engine is not running can serve as a rest abutment, while for the increase of the dynamics with the internal combustion engine running in the area of the first starting position of the control disk, a dynamic initial positioning is performed by an electrical rocking stepper motor provided by a rotary actor, with the roller struck against the end section of the spring. A delivery of electric power to the rocker motor can in this case be so arranged that a stable position held slightly away from the action of the end section of the spring arm is achieved, which is quickly overcome in case of a signal for opening the charge exchange valve, which applies up to a predetermined rocker motor frequency.

Furthermore, a structurally advantageous embodiment of the second rotary stop is achieved by the invention by the fact that the end section of the spring arm of the coil spring bears a resilient abutment hook at its free end as the second end rotary abutment which limits the opening stroke of the poppet valve in cooperation with the roller, while the control disk has in the corresponding cam breakover point an arch coaxial with the shaft. With this arch uniform starting conditions are advantageously assured.

The invention makes possible, in addition to valve operation with maximum valve-open and valve-closed position, also a valve drive with variable strokes, for which it is further proposed that the rocking stepper motor performing alternating rotary movements by a control can be operated to achieve a variable stroke of the poppet valve at least in the opening direction in a microstepping operation. For this purpose the rotor can be stopped after a positive current by a negative current, and during the partial stroke it can be held by the corresponding rotor torque.

In order in this case to keep the need for energy relatively low, it is provided according to the invention that, for partial strokes of the poppet valve dependent on working point, the bias force of the spring arm acting on the lever is variable by changing the position of the spring arm relative to the cylinder head.

For low-friction valve operation it is furthermore proposed that the control disk cooperates with a roller type cam follower and that the roller type cam follower is arranged to be supported against the cylinder head through a valve play equalizing element. In further development, a rocking stepper motor can serve as rotary actor for a plurality of similar poppet valves of a cylinder of the internal combustion engine. Lastly, in addition to a roller type cam follower as an additional transfer means and, if desired, in combination with a hydraulic valve play equalizing element, a toggle lever and/or tappet are possible.

Other objects, advantages and novel features of the present invention will become apparent from the following detailed description of the invention when considered in conjunction with the accompanying drawings.

DETAILED DESCRIPTION OF THE DRAWINGS

Figure 2:
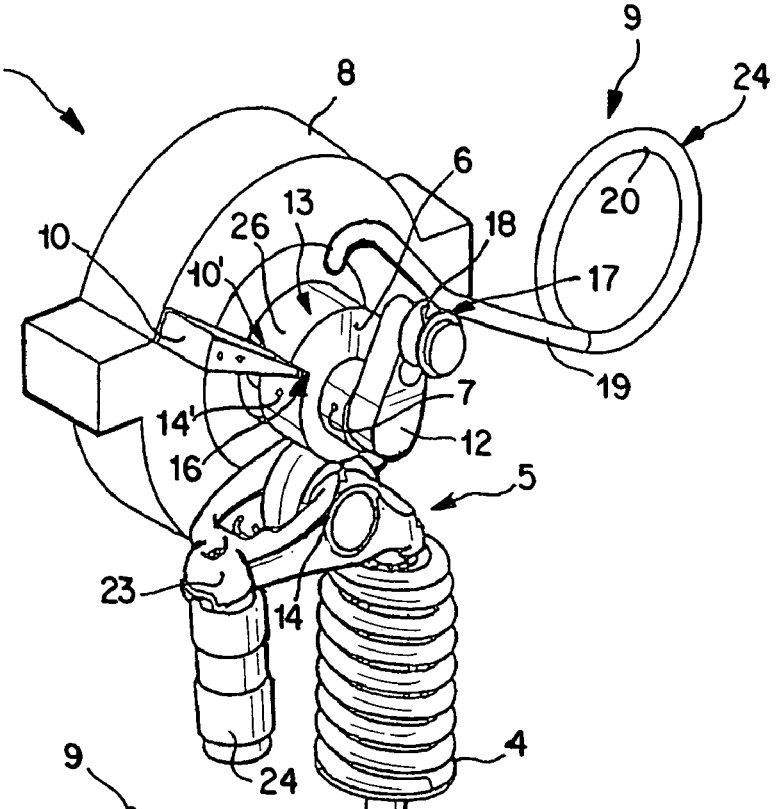
FIG. 2 shows this rotary actor apparatus in a perspective view with arms of the springs acting on the roll of the lever for acceleration.
Figure 1:
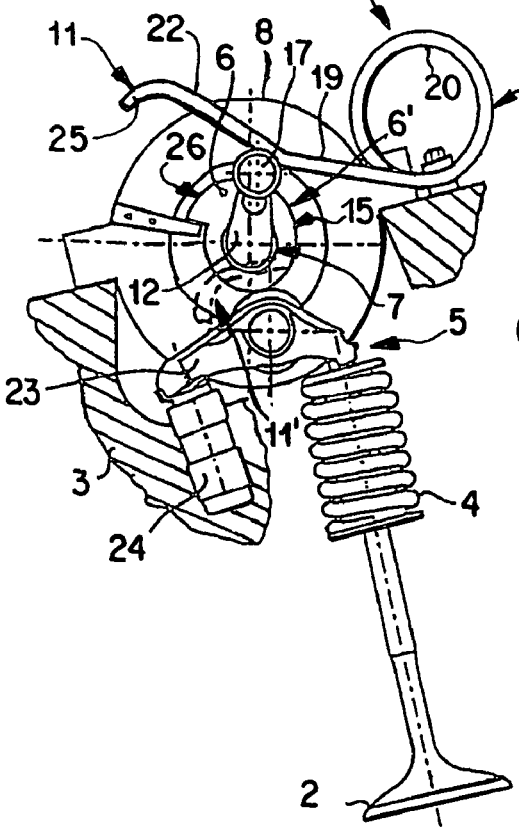
FIG. 1 shows a rotary actor apparatus in an end view.

FIGS. 1 and 2 illustrate a rotary actor apparatus 1 for controlling the stroke of a charge exchange poppet valve 2 in a cylinder head 3 of an internal combustion engine. A poppet valve 2 is operated by a control disk 6 via a transfer element 5. The control disk 6 is non-rotationally joined by a shaft 7 and is in driving connection with a map-controlled, especially electrical rocker motor 8. The rocker motor 8 is operated according to the interaction of the closing spring 4 with one of the closing springs 4 through the control disk 6 of oppositely acting, biased opening springs 9.

In order to bring it about that the control disk 6 will be perfectly secured in the end positions of the poppet valve 2 when the internal combustion engine is not running without powering the rocker motor 8, and furthermore to make it necessary to feed relatively little energy to the rocker motor to get it out of the secured positions, provision is made for the control disk 6 in the closing position as well as in the open position of the poppet valve 2 by means of a separate first and second end rotation abutment 10 and 11, and through the opening spring 9 acting biased against a lever 12 separately arranged on the shaft 7 is held non-rotationally in the particular starting position 10' and 11', the energy stored in the biased springs 4 and 9, though an appropriately selected torque of the rotor of the rocker motor 8 for the opening and closing of the poppet valve 2, serves at a substantially reduced power supply.

The control disk 6 has a cam profile 6' which includes a cam flank 15 formed with a ramp between a cam breakover point 13 and a basic circle 14 for opening and closing which comprises a cam flank 15 formed with a ramp, for which the control disk 6 has, in a diametric area, an arcuate section 14' elongated in the circumferential direction, which is joined at the first end abutment 10 by an abutment 16 directed substantially radially to the cam breakover point for the first abutment 10 arranged on the motor or cylinder head side.

The lever 12 co-rotational with the shaft 7 adjacent to the control disk 6 bears in its free end portion a ball-bearing-mounted roller 17 with a rotating guide wheel 18 by which a free, tensioned spring arm 19 of a coil spring 21 positioned over a coil 20 in and on the cylinder head 3 as an opening spring 9 is carried on the arm portion of lever 12. Furthermore, the control disk 6 that is in contact with the first end abutment 10 when the poppet valve 2 is closed, is secured in this starting position 10' by an end section 22 of the spring arm 19 urged against the roller 17, preferably up to a predetermined rotational frequency of shaft 7.

The end section 22 can be bent away from the spring arm 19 such that a low component of force acts on the roller 17 in opening the poppet valve 2, and facilitates the starting of the rocker motor 8.

Also, the bend of the end section 22 away from the spring 21 is made such that in the case of opening stroke of the poppet valve 2 achieved at the second end abutment 11 on the rotor of the rocker motor 8 a torque approaching zero is produced.

Furthermore, the first end abutment 10 formed from a leaf spring can serve as a stop abutment when the internal combustion engine is not running. When the internal combustion engine is running, then in the area of the first starting position 10' of the control cam 6 a dynamic start positioning with roller 17 striking against the end section 22 of the spring's arm can be accomplished by an electrical stepper motor provided as a dynamic start-positioning means.

A structurally advantageous and simple configuration of the second end abutment 11 is furthermore achieved by the fact that the end section 22 of the spring arm 19 of spring 21 bears at its free end a resilient stop hook 25 which limits the opening stroke of the poppet valve 2 in cooperation with the roller 17 and serves as a second rotational end stop 11, while the control disk 6 has if desired, in the corresponding area of the cam breakover angle, an arcuate portion 26 coaxial with the shaft to prevent any catch that has to be overcome with the input of energy.

A special advantage of the rotary actor device 1 according to the invention results if on the far side of the predetermined rocking frequency of the shaft 7 the starting positions 10' and 11', with a bouncing movement in the starting positions 10' and 11', an accelerated reversal of the shaft 7 and of the rotor of the rocking motor 8 is achieved, so that beyond the predetermined rocking frequency of the shaft 7 substantially no energy has to be provided to the rocker motor 8 to overcome the secured starting position 10', 11'.

In the embodiment of the invention represented in the drawings, the rotational end abutment 10 is formed of a leaf spring which is so stiff that, until the predetermined rocking frequency of the shaft 7 is reached, it acts like a rigid stopping abutment for the abutment 16 on the shaft, and which, when the predetermined rocking frequency of the shaft 7 exceeds the preset rocking frequency of the shaft 7, resiliently withdraws this abutment 16 with the shaft 7 in a kind of ricochet, and the rotor of the rocker motor 8 joined thereto. This is similarly true also for the end-turning stoke 11 in the configuration of a resilient impact hook 25 on the spring arm 19 of the lever 21, the ball-bearing mounted roller 17 serving as an abutment on the lever 12 at the shaft end.

Instead of the resilient end rotation abutment 10 it is also possible to make it rigid and also to provide the corresponding abutment 16 on the control disk 6 with hardened abutment surfaces, so that in the case of striking together at high speed a ricocheting movement is also initiated.

To expand the working range of the rotary actor apparatus 1, the rocking stepper motor 8 performing alternating rotatory movements by an actuation for the achievement of a variable stroke of the plate valve 2 can be operated by a micro-step drive at least in the valve-opening direction. Thus any desired smaller valve stroke from the closed position of the poppet valve 2 can be achieved. In order in this case to keep the energy requirement of the rocking step motor 8 relatively low the bias force of the spring arm 19 acting on the lever for partial strokes of the poppet valve according to the working point can be varied by shifting the position of the spring 21 relative to the cylinder head (not shown).

The rotary actor apparatus 1 pursuant to the invention makes it possible in an advantageous manner, especially in regard to its manufacture, to combine the control disk 6 with an intermediate knuckle arm 23, the knuckle arm 23 being arranged to thrust against the cylinder head 3 through a hydraulic valve clearance equalizing element or HVA 24. With the HVA 24 a play-free cooperation of control disk 6 and the intermediate knuckle arm 23 is achieved in a known manner, with the advantage that with the rotary actor device 1 according to the invention even minimal strokes of the poppet valve 2 are possible.

The drawing shows a rocking stepper motor 8 associated with a single poppet valve 2, but one which can also serve as a rotary actor for several similar poppet valves 2, especially intake valves, of a cylinder of the internal combustion engine, a single rocking stepper motor 8 being provided and one shaft 7 with control disks 6 with an appropriate number of poppet valves 2.

In addition to one intermediate roller knuckle arm 23 and one intermediate knuckle arm, the rotary actor device 1, in combination in some cases with a hydraulic valve free-play equalizing element, an intermediate knuckle arm and/or a tappet can be provided.

In the rotary actor device 1, the opening force of the gas exchange valves is the result of the kinetic turning energy of the actor rotor achieved by the cooperation of the opening spring 9 and closing spring 4, and from the positive coupling of the rotor through the control disk 6 with the intermediate knuckle arm 23. Thus especially an exhaust valve is opened better and more accurately, while any limitation of the valve diameter in the case of the exhaust valves is substantially eliminated.

With the kinematic conditions according to the invention of the lever kinematic of the leg springs the rotor of the rocking stepper motor 8 is forced in the stating position, contrary to the direction of rotation, against an abutment 10, so that the poppet valve 2 or gas exchange valve remains securely closed and therefore and consequently any current is eliminated. In the maximum stroke position, the cam contact force goes through the cam center or optionally likewise against the direction of rotation against an abutment 11, so that the valve 2 stands stably in the maximum stroke position also without current.

As it can be seen from the above, when the internal combustion engine is started no flow needs to pass through the gas exchange valves and poppet valves before the first full turn of the crankshaft and they are brought to a closed position, as is necessary in the case of stroke actuators. Thus less starting energy is needed and there is less strain on the on-board wiring.

Lastly it is to be noted that the spring 21 chosen by the invention acts through a roller 17 mounted for low friction on a lever 12 and thus produces a torque curve which is advantageously open to choice as to its timing by changing the angle of its lever. By means of the angle to be established when designing the valve operation pursuant to the invention, more attention can be paid to the energy required in the case of partial strokes of the gas change valve 2 so that no extreme values are used for the negative flow required for the partial strokes.

The rocker motor can also be operated or controlled by air or hydraulic pressure through the characteristics of the internal combustion engine. Furthermore, the rocker motor can be in the form of an electric motor or a rotating magnet.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. A rotary actor device for stroke control of a charge-change poppet valve in the cylinder head of an internal combustion engine, comprising a characteristic-curve controlled rocker motor as a rotary actor with a rotor operated alternately between terminal rotary abutments, which serves through a shaft with a control disk fixed thereon for rotation, with a section-wise cam profile of the stroke control of the poppet valve urged by a closing spring, the poppet valve furthermore being forced in the opening direction by means of a spring positioned in/on the cylinder head by a spring arm acting with bias on a lever affixed to a shaft, and furthermore the spring serves for the secure contact with abutments affixed to the shaft against the end rotation abutments associated with the closed position or open position of the poppet valve by means of the spring arm acting on the lever affixed to the shaft, with such reduced force that on the one hand the secured starting position up to a predetermined rocking frequency of the shaft or rotor by means of the rocking motor is overcome at relatively low energy input, and on the other hand, beyond the predetermined rocking frequency the starting position secured in each case is overcome by means of a ricochet movement produced by a resilient deformation of one of the colliding corresponding abutments, then an additional reduced energy input is achieved by means of the rotor of the rocking motor which is chosen to be relatively large corresponding to the energy exchange of the closing spring and poppet valve.

2. The device according to claim 1, wherein the rocker motor is supplied with electrical or pneumatic or hydraulic energy.

3. The device according to claim 1, wherein the ricochet movement of corresponding abutments is achieved by means of harder abutting surfaces or by means of a stiff resilient abutment.

4. The device according to claim 3, wherein the control disk comprises a half-cam profile which has a cam flank configured with a ramp between a cam break-over point and a basic circuit for opening and closing, to which the control disk has in a diametrical area a basic circular section which is adjoined by an abutment directed substantially radially to the cam break-over area for the end rotary abutment disposed at the motor or cylinder head side.

5. The device according to claim 4, wherein the lever turning with the shaft adjacent the control disk bears in its free end area a roller-bearing mounted roller with a rotating guiding roller, by means of which the free, biased spring arm made of round wire and carried through a screw thread-like coil above the range of the swing of the lever and positioned in/on the cylinder head, and that the control disk lying, when the poppet valve is closed, against the first terminal rotary abutment is secured in this initial position by means of a bent end section of the spring arm urged against the roller.

6. The device according to claim 5, wherein the end section is bent away from the spring arm such that a relatively small force component acting in the opening direction of the poppet valve acts against the roller.

7. The device according to claim 5, wherein the end section is further bent away from the spring arm of the spring such that in the opening stroke of the poppet valve achieved in the second end rotary abutment a torque approaching zero is applied to the rotor of the rocking motor.

8. The device according to claim 4, wherein the control disk cooperates with an intermediate knuckle arm and wherein the intermediate knuckle arm is disposed supported against the cylinder head through a hydraulic valve play compensating element (HVA 24).

9. The device according to claim 4, wherein a toggle lever and/or hydraulic valve lifter serves as an additional transfer element and in some cases combined with a hydraulic valve play equalization element (HVA).

10. The device according to claim 3, wherein the first end rotary abutment formed from a flat spring serves as a stop abutment when the internal combustion engine is not running, and that when the internal combustion engine is running, up to a predetermined rocking frequency in the range of the first starting position of the control disk, a dynamic starting positioning with a roller abutting against the end section of the spring arm is brought about by means of an electrical rocking stepper motor provided as rotary actor.

11. The device according to claim 8, wherein the rocker stepper motor performing alternating rotational movements by means of an actuator for the achievement of a variable stroke of the poppet valve can be driven in a micro-step operation at least in the valve opening direction.

12. The device according to claim 11, wherein, for partial strokes of the poppet valve 2 dependent upon the working point, the bias force of the spring arm 10 acting on the lever is controllingly variable by means of change of the position of the spring arm relative to the cylinder head.

13. The device according to claim 10, wherein a rocking stepper motor serves as a rotary actor for a plurality of similar tappet valves of a cylinder of the internal combustion engine.

14. The device according to claim 3, wherein the end section of the spring arm of the spring bears at its free end a resilient abutment hook as a second end rotary abutment limiting the opening stroke of the poppet valve in cooperation with the roller, and wherein the control disk has in the corresponding cam break-over point in some cases an arc coaxial with the shaft.

15. A rotary actor device for stroke control of a charge-change poppet valve in a cylinder head of an internal combustion engine, the device comprising:

a rocker motor having a rotor that is rotatable alternately between two terminal positions defined by two terminal abutments and is connected to two abutments that contact the terminal abutments when the rotor is at the terminal positions, and wherein when the rotor is at the terminal positions, the poppet valve is at the closed and open positions;

a control disk connected to the rotor and having a section-wise cam profile for controlling the stroke of the poppet valve;

a closing spring urging the poppet valve against the cam profile in the direction of the poppet valve's closing position;

an opening spring urging the poppet valve in the poppet valve's opening direction;

a lever connected to the control disk, wherein the opening spring acts on the lever so that when the rotor is at the terminal abutments, the opening spring urges the rotor against the terminal abutments with such a reduced force that the terminal positions up to a predetermined rocking frequency of the rotor are overcome at a relatively low energy input, and beyond the predetermined rocking frequency the terminal positions are overcome by a ricochet movement produced by a resilient deformation of one of the two terminal abutments and the two abutments connected to the rotor, and wherein an additional reduced energy input is achieved by the rotor of the rocking motor which is relatively large corresponding to the energy exchange of the closing spring and poppet valve.

16. The device according to claim 15, wherein the rocker motor includes an electrical, pneumatic or hydraulic motor.

17. The device according to claim 15, wherein the ricochet movement of the abutments is achieved by harder abutting surfaces or by a stiff resilient abutment.

18. The device according to claim 17, wherein the control disk comprises a half-cam profile which has a cam flank configured with a ramp between a cam break-over point and a basic circuit for opening and closing, to which the control disk has in a diametrical area a basic circular section which is adjoined by one of the abutments that is connected to the rotor and directed substantially radially to a cam break-over area for one of the rotary abutments disposed at the motor side.

19. The device according to claim 18, wherein the opening spring has a spring arm, wherein the lever turning with the rotor adjacent the control disk bears in its free end a roller-bearing roller with a rotating guiding roller, by which the spring arm made of round wire and carried through a screw thread-like coil above the range of the swing of the lever, and wherein the control disk lying, when the poppet valve is closed, against one of the terminal abutments is secured in this initial position by a bent end section of the spring arm urged against the roller.

20. The device according to claim 19, wherein the bent end section is bent away from the spring arm such that a relatively small force component acting in the opening direction of the poppet valve acts against the roller.

21. The device according to claim 19, wherein the bent end section is further bent away from the spring arm of the spring such that in the opening stroke of the poppet valve achieved in the other rotary abutment a torque approaching zero is applied to the rotor of the rocking motor.

22. The device according to claim 19, wherein one of the terminal abutments formed from a flat spring serves as a stop abutment when the internal combustion engine is not running, and wherein when the internal combustion engine is running, up to the predetermined rocking frequency in the range of one of the terminal positions, a dynamic starting positioning with a roller abutting against the end section of the spring arm is brought about by the rocker motor that is an electrical rocking stepper motor.

23. The device according to claim 22, wherein the rocker stepper motor for the achievement of a variable stroke of the poppet valve can be driven in a micro-step operation at least in the valve opening direction.

24. The device according to claim 23, wherein, for partial strokes of the poppet valve 2 dependent upon the working point, the bias force of the spring arm 10 acting on the lever is controllingly variable by means of change of the position of the spring arm relative to the cylinder head.

25. The device according to claim 22, wherein a rocking stepper motor serves as a rotary actor for a plurality of similar tappet valves of a cylinder of the internal combustion engine.

26. The device according to claim 19, wherein the end section of the spring arm of the spring bears at its free end a resilient abutment hook as a second end rotary abutment limiting the opening stroke of the poppet valve in cooperation with the roller, and wherein the control disk has in the corresponding cam break-over point in some cases an arc coaxial with the shaft.

27. The device according to claim 18, wherein the control disk cooperates with an intermediate knuckle arm and wherein the intermediate knuckle arm is disposed supported against the cylinder head through a hydraulic valve play compensating element (HVA 24).

28. The device according to claim 18, wherein a toggle lever and/or hydraulic valve lifter serves as an additional transfer element and in some cases combined with a hydraulic valve play equalization element (HVA).

* * * * *